US011259588B2

(12) United States Patent
Young et al.

(10) Patent No.: US 11,259,588 B2
(45) Date of Patent: Mar. 1, 2022

(54) ATHLETIC HELMET

(71) Applicants: William O. Young, Spartanburg, SC (US); William O Young, Jr., Greensboro, NC (US)

(72) Inventors: William O. Young, Spartanburg, SC (US); William O Young, Jr., Greensboro, NC (US)

( * ) Notice: Subject to any disclaimer, the term of this patent is extended or adjusted under 35 U.S.C. 154(b) by 0 days.

(21) Appl. No.: 16/424,657

(22) Filed: May 29, 2019

(65) Prior Publication Data

US 2020/0146385 A1 May 14, 2020

Related U.S. Application Data

(60) Provisional application No. 62/763,019, filed on May 29, 2018.

(51) Int. Cl.

| | |
|---|---|
| ***A45B 3/06*** | (2006.01) |
| ***A42B 3/06*** | (2006.01) |
| ***A42B 3/10*** | (2006.01) |

(52) U.S. Cl.

CPC ..... *A42B 3/062* (2013.01); *A42B 3/10* (2013.01)

(58) Field of Classification Search

CPC .... A42B 3/10; A42B 3/12; A42B 3/06; A42B 3/062; A42B 3/064

See application file for complete search history.

(56) References Cited

U.S. PATENT DOCUMENTS

| | | | | | |
|---|---|---|---|---|---|
| 1,251,537 | A * | 1/1918 | Kempny | A42B 3/0473 | 2/6.8 |
| 2,197,174 | A * | 4/1940 | Crosby | A42B 3/06 | 2/6.8 |
| 3,872,511 | A * | 3/1975 | Nichols | A42B 3/121 | 2/413 |
| 4,224,694 | A * | 9/1980 | Palmaer | A42B 3/166 | 2/422 |
| 4,547,908 | A * | 10/1985 | Karlsson | A42B 3/10 | 2/424 |
| 6,249,386 | B1 * | 6/2001 | Yona | A42B 3/042 | 2/414 |
| 6,378,140 | B1 * | 4/2002 | Abraham | A42B 3/064 | 2/411 |
| 9,642,410 | B2 * | 5/2017 | Grice | A42B 3/06 | |
| 10,244,809 | B2 * | 4/2019 | Linares | A42B 3/064 | |
| 10,595,577 | B1 * | 3/2020 | Lewis | A63B 71/10 | |

(Continued)

FOREIGN PATENT DOCUMENTS

| | | | |
|---|---|---|---|
| CA | 2260549 | A1 * | 8/2000 |
| GB | 191312553 | A * | 2/1914 |

OTHER PUBLICATIONS

Definition of unsecured found in Collins English Dictionary—Complete & Unabridged 2012 Digital Edition © William Collins Sons & Co. Ltd. 1979, 1986 © Harpercollins Publishers 1998, 2000, 2003, 2005, 2006, 2007, 2009, 2012 (Year: 2012).*

(Continued)

*Primary Examiner* — Clinton T Ostrup
*Assistant Examiner* — Andrew Wayne Sutton

(57) ABSTRACT

Compressible conical springs with unsecured tabs are positioned between an outer helmet and an inner rigid liner to absorb and distribute impact forces to minimize concussion risks and other head injuries.

9 Claims, 5 Drawing Sheets

(56) References Cited

U.S. PATENT DOCUMENTS

| | | | | |
|---|---|---|---|---|
| 2004/0218776 | A1* | 11/2004 | Rolla | A42B 3/166<br>381/374 |
| 2016/0029730 | A1* | 2/2016 | Day | F16F 3/0873<br>2/412 |
| 2016/0161222 | A1* | 6/2016 | Lee | A42B 3/14<br>2/416 |
| 2017/0112220 | A1* | 4/2017 | Suddaby | A42B 3/0453 |
| 2017/0251744 | A1* | 9/2017 | Suddaby | A42B 3/064 |
| 2018/0228239 | A1* | 8/2018 | Day | A42B 3/064 |
| 2019/0328073 | A1* | 10/2019 | Morgan | A42B 3/124 |
| 2020/0305535 | A1* | 10/2020 | Chung | A42B 3/064 |

OTHER PUBLICATIONS

Diamond, Jared "A Mask That Might Save Catchers' Careers." Wall Street Journal, Eastern edition; New York, N.Y. [New York, N.Y]. Oct. 5, 2021: A.14. 5 pages.

* cited by examiner

ATHLETIC HELMET

RELATED APPLICATIONS

This application claims the benefit of provisional application Ser. No. 62/763,019, filed May 29, 2018 and which is incorporated herein by reference.

FIELD OF THE INVENTION

This invention is directed towards a safety helmet to protect against head injury, including helmets design for American football. This invention is further directed to a helmet which uses conical compressible springs positioned between an outer helmet and an inner rigid liner to absorb and distribute the force of impact and thereby minimize the risk of concussion and other head injuries. The conical compressive springs use the space between the helmet and the liner to absorb impact and minimize the forces of a blunt force, high impact blow. The conical springs will allow uniform deacceleration and absorb and dissipate impact forces more efficiently than conventional padding absorption used in football and other similar helmets.

BACKGROUND OF THE INVENTION

This invention relates to helmets and more particularly football helmets that may reduce the severity of head injuries and concussions in contact sports. Many sporting events carry with it a risk of concussion to the participates. Concussions are known as mild traumatic brain injury (MTBF) and there is mounting medical evidence that even mild. MTBF events are associated with a greater risk of long-term brain damage associated with the neurodegenerative disease of chronic traumatic encephalopathy (CTE).

While conventional athletic helmets reduce of head injury risks in contact sports, there remains for variation and improvement within the art.

SUMMARY OF THE INVENTION

It is one aspect of at least one of the present embodiments to provide for a helmet comprising:

an outer shell;

an inner shell, the inner shell adapted for placement on an individual's head;

a plurality of conical coil springs, a larger diameter of a base portion of each conical coil spring mounted to an inner surface of the outer shell and a top portion of the smaller diameter tip of each conical spring defining a low coefficient of friction tab member, the base portion of the conical coils spring having a larger diameter than the top portion and each tab member in contact with an exterior surface of the inner shell;

wherein, when a force is applied to the exterior of the outer shell, the coil springs can compress into a fully flattened position thereby absorbing the force and further redistributing the force to a broader region of the helmet.

It is a further aspect, of at least one embodiment of the present invention to provide a helmet consisting of:

an outer shell;

an inner shell, the inner shell adapted for placement on an individual's head;

a plurality of conical coil springs, a base portion of each conical coil spring mounted to an inner surface of the outer shell and a top portion of each spring defining a low coefficient of friction tab member, each tab member in contact with an exterior surface of the inner shell;

wherein, when a force is, applied to the exterior of the outer shell, the coil springs can compress into a fully flattened position thereby absorbing the force and further redistributing the force to a broader region of the helmet.

It is a further aspect of at least one embodiment of the present invention to provide a helmet wherein each tab member of the plurality of coil springs is unsecured relative to the exterior surface of the inner shell.

It is a further aspect of at least one embodiment of the present invention to provide a helmet wherein each tab member of the plurality of coil springs is unsecured relative to the exterior surface of the inner shell.

It is a further aspect of at least one embodiment of the present invention to provide an athletic helmet wherein at least a portion of the interior exterior surface of the inner shell further defines a cushioning substrate that will engage a wearer's head.

It is a further aspect of at least one embodiment of the present invention to provide an athletic helmet wherein the inner shell is moveable relative to the outer shell.

These and other features, aspects, and advantages of the present invention will become better understood with reference to the following description and appended claims.

BRIEF DESCRIPTION OF THE DRAWINGS

A fully enabling disclosure of the present invention, including the best mode thereof to one of ordinary skill in the art, is set forth more particularly in the remainder of the specification, including reference to the accompanying drawings.

DESCRIPTION OF THE PREFERRED EMBODIMENT

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

In describing the various figures herein, the same reference numbers are used throughout to describe the same material, apparatus, or process pathway, To avoid redundancy, detailed descriptions of much of the apparatus once described in relation to a figure is not repeated in, the descriptions of subsequent figures, although such apparatus or process is labeled with the same reference numbers.

As set forth in FIG. 1, an athletic helmet 10, seen in the form of a football helmet, is provided in which the helmet has an outer shell 20 having an interior surface 22 and an exterior surface 24. The outer shell 20 can be comprised of conventional materials including high impact plastics, HDPE, PE, nylons, Kevlar fibers, carbon fiber composites, polycarbonates, ABS and various mixtures of such materials as is conventionally used for protective helmets.

Figure 1A:
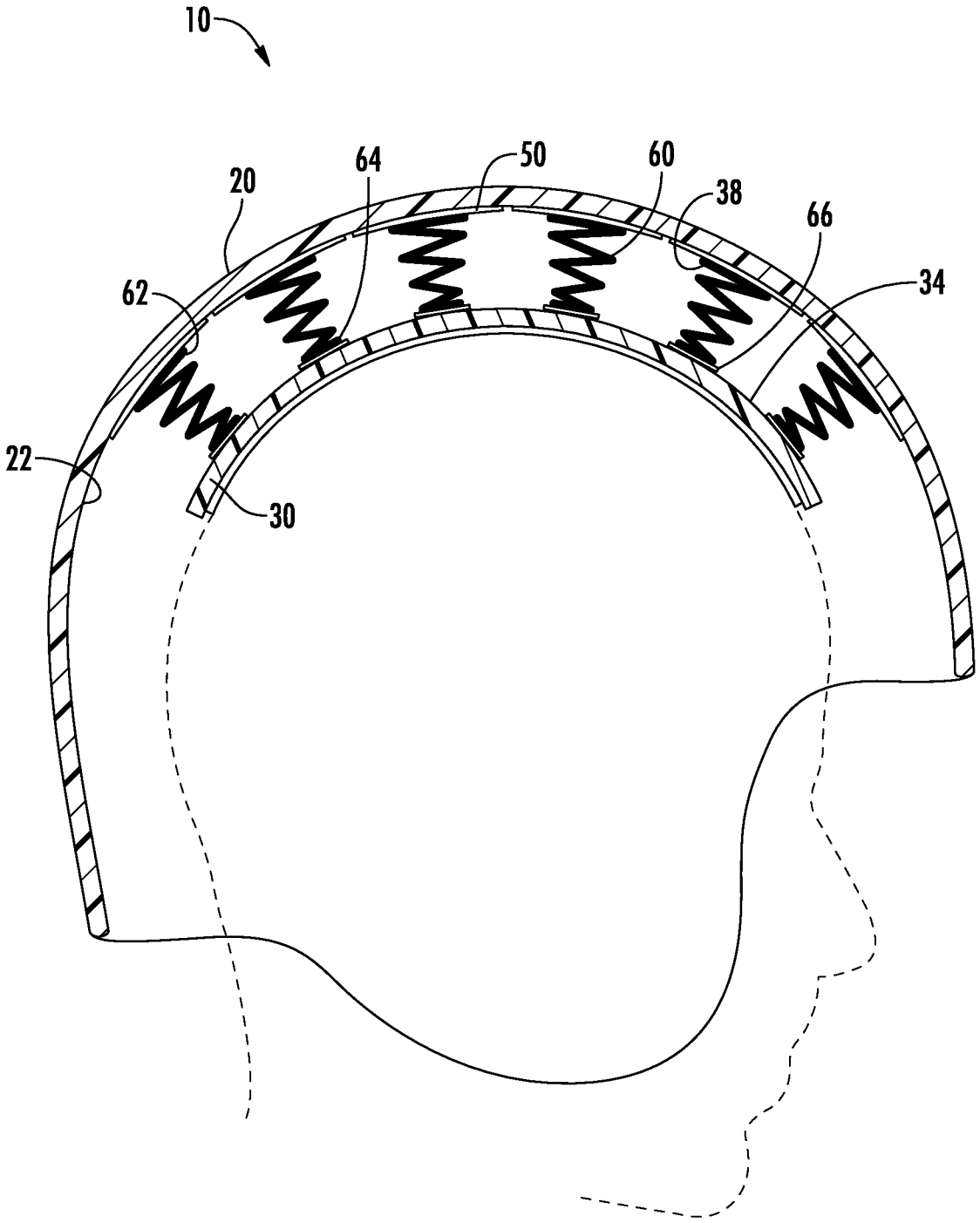
FIG. 1A is a sectional view of a football helmet in accordance with one embodiment of the present invention.
Figure 1B:
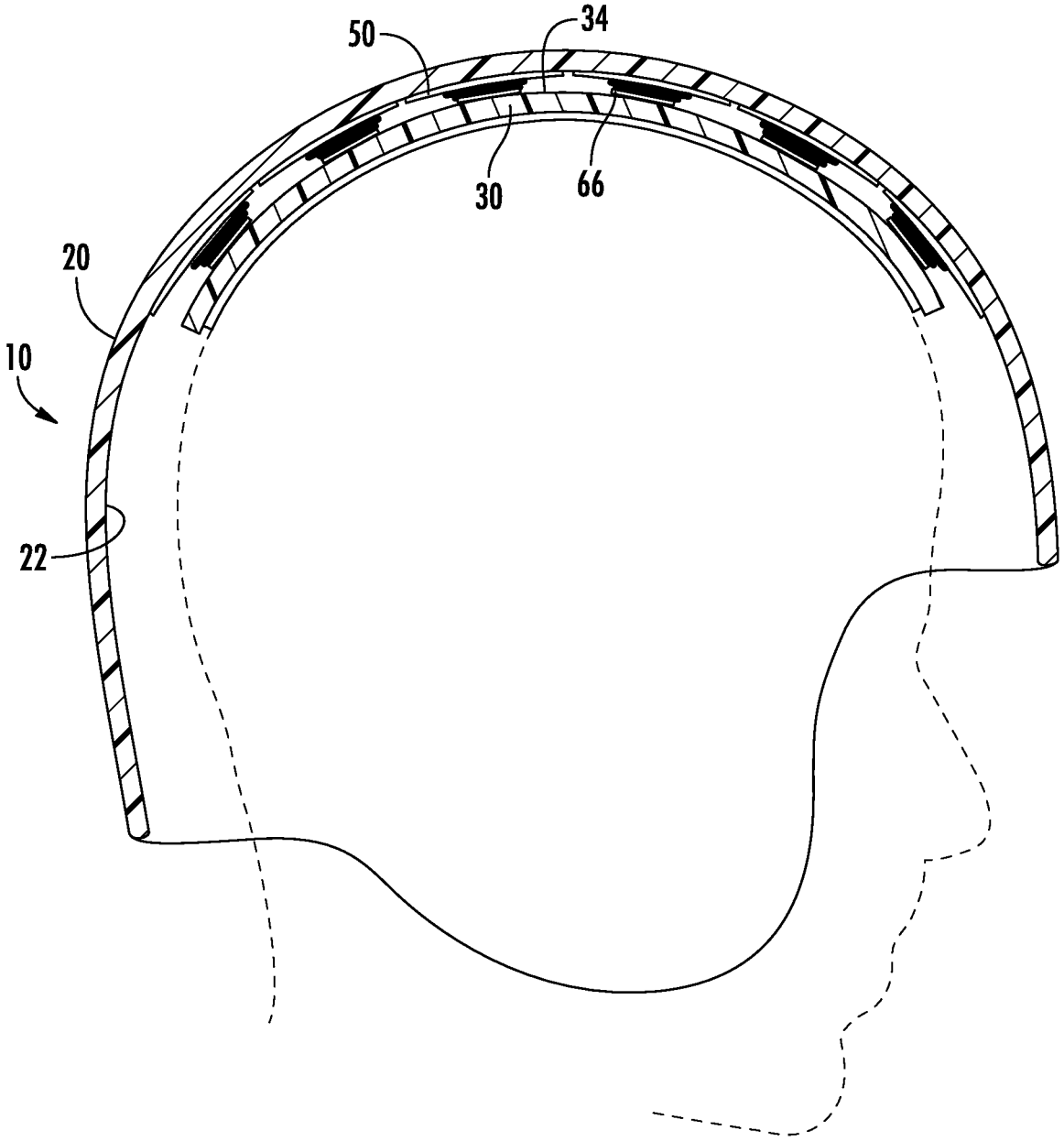
FIG. 1B is a view similar to FIG. 1A showing the conical coil springs in a compressed configuration.

As seen in reference to FIGS. 1A & 1B, an inner shell 30 will nest within an interior portion of helmet 10 and is a spaced distance from an outer shell 20. The inner shell 30 provides an inner surface 32 and an outer surface 34 and is adapted for placement on a wearer's head.

As seen in the figures, an inner surface 22 of outer shell 20 supports a plurality of conical coil springs 60, each coil spring 60 being attached along a wider base portion 62 to the outer shell 20. Preferably, each coil spring has four coils and a free height of about 1 inch in an uncompressed state. A terminal region 64 of each conical coil spring 60 further defines a tabbed member 66 that may be in the form of a disk of a low coefficient of friction material such as a high density polyethylene, a UHMWPE, a Teflon® coated plastic, nylon, or other suitable material that will engage the outer surface 34 of inner shell 30. As illustrated, the tab member 66 ideally has a size corresponding to the terminal circumference of the outer end 64 of coil spring 60. This allows for an efficient contact surface between the tab member 66 and the outer surface 34 of inner shell 30.

In one embodiment, each conical coil spring 60 may be adhered to an inner surface 22 of outer shell 20 using an adhesive fabric backing 50 which secures a lower ring 38 of conical coil spring 30 to surface 22. Alternatively, the lower ring 38 can be press fit into an appropriately sized recess or detest.

In accordance with the present invention, it has been found useful to allow the tab member 66 to slide and move relative to the outer surface 34 of the inner shell. In this manner, impacts directed to the helmet 10 can be more efficiently absorbed and distributed in a force reducing manner as opposed maintaining a fixed position between the outer portion of coil springs 64 and the outer surface 34 of inner shell 30. Additionally, the outer liner and inner liner of are not rigidly connected together and can therefore move relative to each other. In some embodiments, the shell 20 and shell 30 may be tethered together with a connecting cord, zip ties, or elastic bands.

Figure 3:
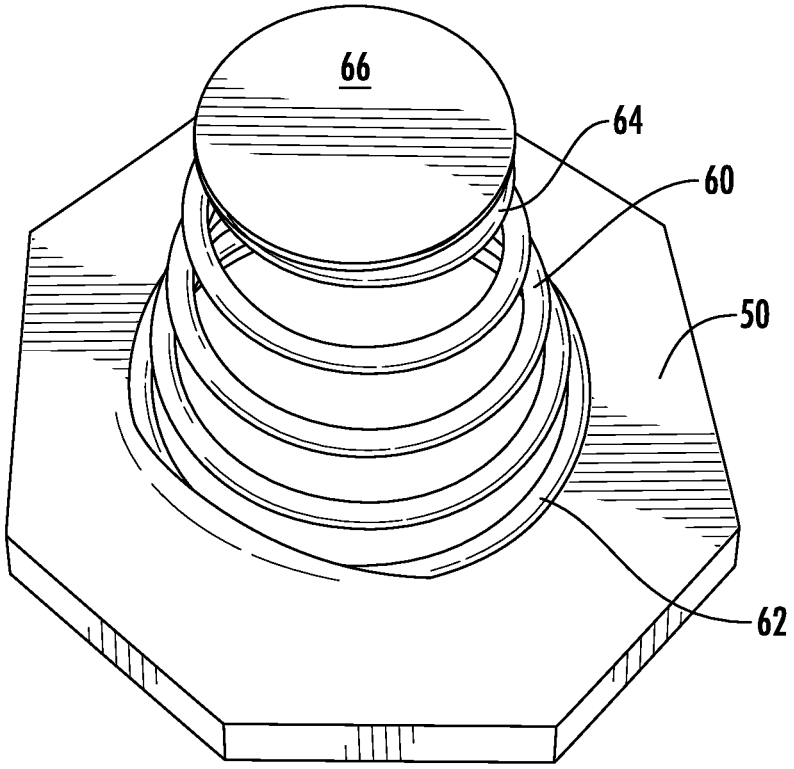
FIG. 3 is a perspective view of a coil spring having a low coefficient of friction tab member secured to a tip portion of the coil spring.

As best seen in reference to FIG. 3, details of the coil spring 60 can be seen showing the lower coil region 62, the outer coil region 64, the tab member 66 along with the adhesive fabric base 50 used to secure the coil spring 60 to the interior surface 22 of the outer shell 20. One non-limiting construction of the coils spring seen in FIG. 3 has a base outer diameter of 1.5 inches and each coil having a sufficiently smaller outer diameter so as to be able to fully nest within the confines of the other coils.

In one non-limiting embodiment, the conical spring will fully compress upon receiving 150 pounds of force, has a wire diameter of 0.10 inches, has four coils with a tip inner diameter of ⅜ of an inch and a base outer diameter of 1.5 inches and a height of about 1.0 inches.

Figure 2A:
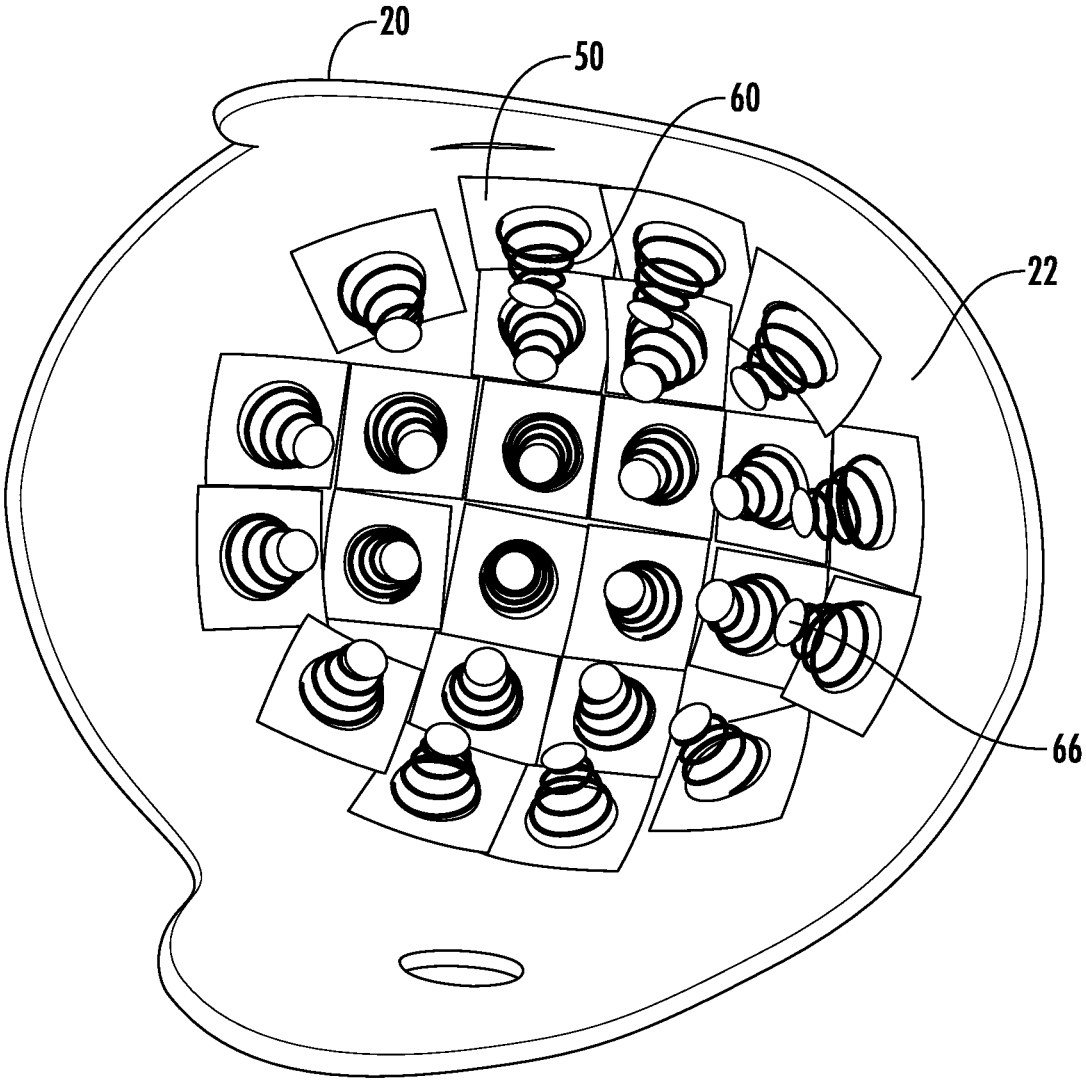
FIG. 2A is a perspective view of an interior portion of a helmet outer shells showing an arrangement of coil springs.
Figure 2B:
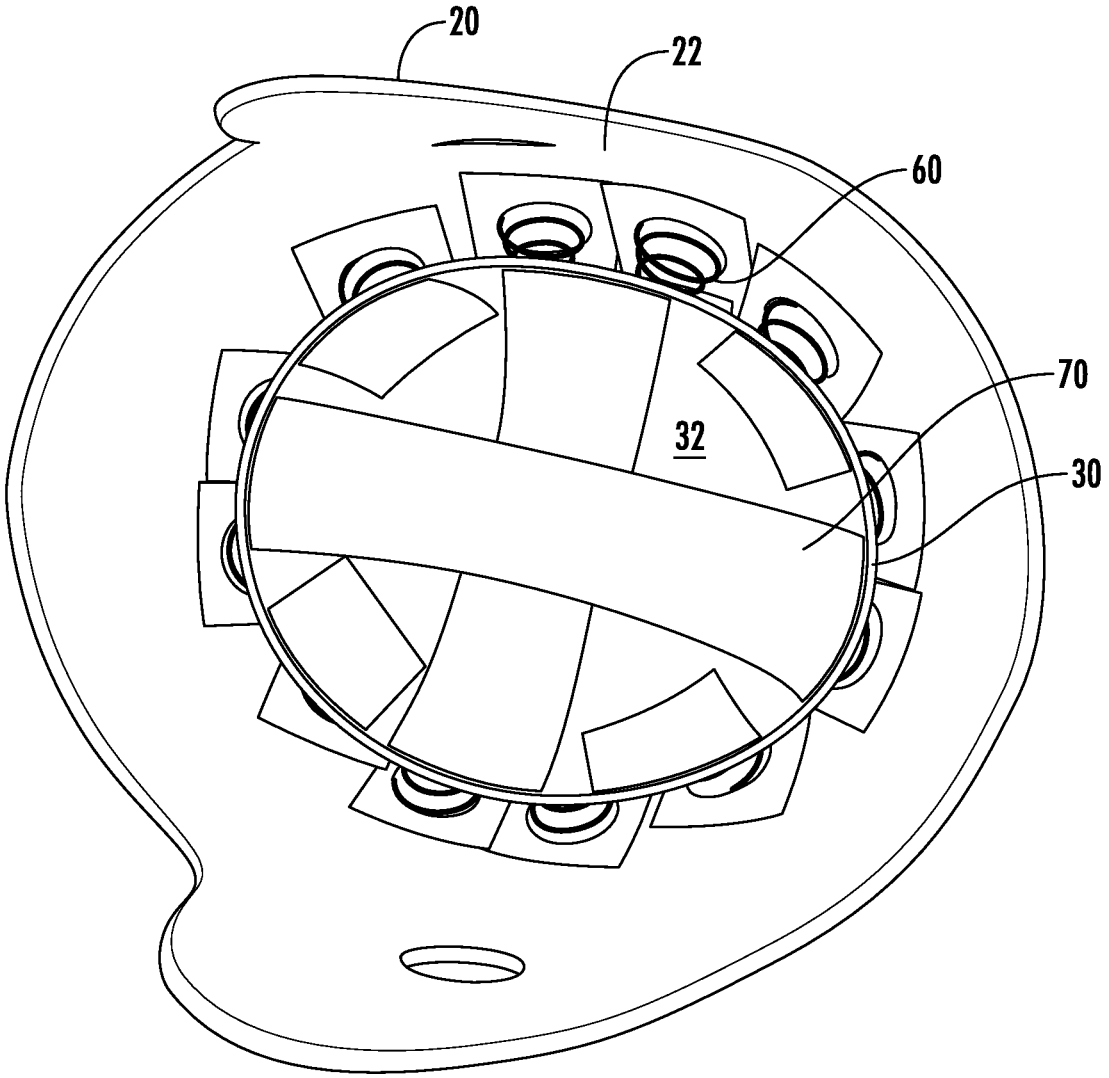
FIG. 2B is a perspective view showing the interior of a helmet with the inner shell positional within the outer shell.

One aspect of the illustrated embodiment of the invention provides for a helmet in which each conical coil spring 60 is able to fully compress to a substantially flat orientation as seen in reference to FIG. 2. The conical shape of the spring will allow the coils to fully nest within the confines of the other coils such that the liner and helmet may, under impact, be pressed together such that the liner and outer helmet are separated by, a distance corresponding to the diameter of the wire used to form the coil. In an uncompressed state, the liner and outer helmet are separated by about one inch. While FIG. 2 illustrates all the coils in a fully compressed state, one of ordinary skill in the art will understand that depending upon the area of impact, some springs will compress to a greater extent than other springs. The conical spring tips in some places may slide across the liner surface while other springs would tend to compress more or fully.

This arrangement allows one to select coil springs having a desired compression rating to provide sufficient impact resistance and force distribution. Ideally, the maximum protection against head inquiry from blunt impact forces will utilize a coil spring having a compression resistance which approaches, but does not exceed, the elastic stress limit of the material comprising the spring.

As best seen in reference to FIG. 2A, one embodiment of the invention sets forth a plurality of intersecting horizontal and vertical rows of coil springs. In order to provide the maximum value from the compressive spring forces, it is an aspect of the invention that there is no conventional padding or other material present between the inner shell and the outer shell that would prevent the full compression of the spring. In other words, padding or foam supports that might typically used in the region between the inner and outer shells is not present so as to allow for full compression of the springs.

Accordingly, it is one aspect of the present invention to provide for a helmet having no foam cushioning member between the inner shell and the outer shell such that the only structure present in that region is the coil spring. The interior surface 34 of inner shell 30 can optionally have fabric 70 or other similar material to allow the shell 30 to fit comfortably on a wearer's heard.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should, not be limited to the description of the preferred versions contained therein.

That which is claimed:

1. An athletic helmet comprising:

an outer shell having an inner surface;

an inner shell having an exterior surface disposed within the outer shell, the inner shell adapted for placement on an individual's head;

a plurality of conical coil springs each having a base portion and a top portion, the base portion of each conical coil spring mounted to the inner surface of the outer shell with an adhesive fabric backing and the top portion of each spring having a tab member attached thereto, each tab member being unsecured to the inner shell, the base portion of conical coil spring having a larger diameter than the top portion and each tab member being in low coefficient of friction contact with the exterior surface of the inner shell;

wherein, when a force is applied to the exterior of the outer shell, the coil springs can each compress from a respective larger diameter in a direction of a respective tab member into a fully flattened position, each tab member contacting and being slidable relative to the exterior surface of the inner shell thereby absorbing and redistributing the force within the helmet.

2. The helmet according to claim 1 wherein each tab member of the plurality of coil springs is unsecured relative to the exterior surface of the inner shell.

3. The helmet according to claim 1 wherein at least a portion of the interior exterior surface of the inner shell further defines a fabric substrate.

4. The helmet according to claim 1 wherein the inner shell is moveable relative to the outer shell when the helmet is worn.

5. The helmet according to claim 1, wherein the spaced distance between the outer shell and the inner shell has no cushioning material present.

6. An athletic helmet consisting of:

an outer shell;

an inner shell, the inner shell adapted for placement on an individual's head;

a plurality of conical coil springs, a base portion of each coil spring secured to an inner surface of the outer shell with an adhesive fabric backing and a top portion of each spring having a tab member attached thereto, each tab member being unsecured to the inner shell, the base portion of the conical coil spring having a larger diameter than the top portion and each tab member being in low coefficient of friction contact with an exterior surface of the inner shell;

wherein, when a force is applied to an exterior of the outer shell, the coil springs can compress into a fully flattened position, each tab member contacting and being slidable relative to the exterior surface of the inner shell thereby absorbing the force and redistributing the force within the helmet.

7. The helmet according to claim 6 wherein each tab member of the plurality of coil springs is unsecured relative to the exterior surface of the inner shell.

8. An athletic helmet, comprising:

an outer shell having an inner surface;

an inner shell having an exterior surface disposed within the outer shell, the inner shell adapted for placement on an individual's head and being movable relative to the outer shell;

a plurality of springs each having a base portion and a top portion, the base portion of each spring mounted to the inner surface of the outer shell with an adhesive fabric backing and the top portion of each spring having a tab member unsecured relative to the exterior surface of the inner shell, the base portion having a larger diameter than the top portion of the spring, and each tab member being in slidable contact with the exterior surface of the inner shell with a low coefficient of sliding friction between the tab member and the exterior surface;

wherein, when a force is applied to the outer shell, the springs are configured to compress thereby causing one or more of the tab members to slidably contact the exterior surface of the inner shell thereby absorbing the force and redistributing the force within the helmet.

9. The athletic helmet according to claim 8, wherein at least a portion of the interior surface of the inner shell is covered with a cushioning substrate.

* * * * *